United States Patent [19]

Duchene et al.

[11] Patent Number: 4,999,996

[45] Date of Patent: Mar. 19, 1991

[54] SYSTEM FOR MOUNTING A PRE-VAPORIZING BOWL TO A COMBUSTION CHAMBER

[75] Inventors: Francois Duchene, Melun; Alexandre Forestier, Vaux Le Penil, both of France

[73] Assignee: Societe Nationale D-Etude Et De Construction De Moteurs D-Aviation (S.N.E.M.A.), Evry Cedex, France

[21] Appl. No.: 437,676

[22] Filed: Nov. 17, 1989

[30] Foreign Application Priority Data

Nov. 17, 1988 [FR] France ..... 88 14915

[51] Int. Cl.[5] ..... F02C 7/20; F23R 3/46

[52] U.S. Cl. ..... 60/39.32; 60/740; 60/752

[58] Field of Search ..... 60/39.32, 737, 748, 60/743, 740, 756, 39.31; 431/350, 351

[56] References Cited

U.S. PATENT DOCUMENTS

| | | | |
|---|---|---|---|
| 2,509,503 | 5/1950 | Huyton | 60/39.31 |
| 3,273,343 | 9/1966 | Cretella . | |
| 3,589,127 | 6/1971 | Kenworthy et al. . | |
| 4,180,972 | 1/1980 | Herman et al. | 60/39.32 |
| 4,322,945 | 4/1982 | Peterson et al. | 60/39.32 |
| 4,365,470 | 12/1982 | Matthews et al. | 60/39.32 |
| 4,454,711 | 6/1984 | Ben-Porat | 60/748 |
| 4,525,996 | 7/1985 | Wright et al. | 60/39.31 |
| 4,686,823 | 8/1987 | Coburn et al. | 60/740 |
| 4,696,157 | 9/1987 | Barbier et al. . | |
| 4,726,182 | 2/1988 | Barbier et al. . | |
| 4,754,600 | 7/1988 | Barbier et al. . | |
| 4,914,918 | 4/1990 | Sullivan | 60/39.32 |

FOREIGN PATENT DOCUMENTS

| | | |
|---|---|---|
| 1547843 | 11/1968 | France . |
| 710353 | 6/1954 | United Kingdom . |

*Primary Examiner*—Louis J. Casaregola
*Assistant Examiner*—Timothy S. Thorpe
*Attorney, Agent, or Firm*—Bacon & Thomas

[57] ABSTRACT

A system is disclosed for mounting the pre-vaporizing bowl to a wall of a turbine engine combustion chamber in such a manner that it is centered and in alignment with an opening, through the combustion chamber wall during assembly. Not only does the system provide for the centering of the pre-vaporizing bowl in the combustion chamber wall opening, but it also allows relative radial movement between these elements after the engine has been assembled. The system includes a support collar fixedly attached to the combustion chamber wall so as to extend around the generally circular opening in the upstream portion of the combustion chamber, as well as a locating flange fixedly attached to the pre-vaporizing bowl. A stud extending from the locating flange extends through a slot in the support collar such that only radial movement between the locating lfange and the support collar (and consequently between the pre-vaporizing bowl and the combustion chamber wall) is permitted. A resilient snap clip is interposed between the support collar and the locating flange.

10 Claims, 4 Drawing Sheets

SYSTEM FOR MOUNTING A PRE-VAPORIZING BOWL TO A COMBUSTION CHAMBER

BACKGROUND OF THE INVENTION

The present invention relates to a system for mounting a pre-vaporizing bowl to the upstream end of a combustion chamber wall in a gas turbine engine.

Most present day gas turbine engines, particularly those turbojet engines designed for aircraft use, are equipped with annular combustion chambers extending around a longitudinal axis of the engine. Such engines also have a pre-vaporizing bowl around each fuel injection nozzle interposed between the nozzle and an upstream end wall of the combustion chamber. As is well known in the art, the pre-vaporizing bowls generate air turbulence around the point where the fuel is injected into the combustion chamber to optimize the vaporization of the fuel. Examples of such pre-vaporizing bowls may be found in the following U.S. Pat. Nos. 4,726,182; 4,696,157; and 4,754,600; as well as French Patent 2,585,770.

Since the combustion chamber walls are subjected to very high temperatures during operation of the gas turbine engine, they undergo a generally radial expansion when heated and a generally radial contraction when they are cooled. In order to accommodate the relative radial movement between the combustion chamber walls and the fuel injection nozzle, the pre-vaporizing bowl must be mounted between these elements in such a manner as to allow it to move relative to the combustion chamber wall. Typical examples of such mounting may be found in U.S. Pat. No. 4,322,955 as well as French Patents 1,547,843 and 2,479,952.

Today's turbojet engines are designed as a series of modules which are subsequently assembled to form the engine. The assembly sequence for the combustion chambers is usually accomplished by assembling the combustion chamber (fitted with its pre-vaporizing bowls) to a subassembly that has been equipped with the fuel injector nozzles. The assembly takes place while the engine is in a horizontal orientation and usually involves sliding the combustion chamber subassembly horizontally until it is mated with the subassembly having the fuel injection nozzles.

In this position, gravity urges the radially moveable pre-vaporizing bowls downwardly to a position wherein their centers are slightly eccentric with respect to the centers of the openings through the combustion chamber wall. As a result, the pre-vaporizing bowls may be misaligned with the fuel injection nozzle which presents the danger of damaging contact between the pre-vaporizing bowl and the fuel injection nozzle during the assembly process.

SUMMARY OF THE INVENTION

The present invention relates to a system for mounting the pre-vaporizing bowl to the wall of the combustion chamber in such a manner that it is centered and in alignment with the opening through the combustion chamber wall during the assembly process. Not only does the system provide for the centering of the pre-vaporizing bowl in the combustion chamber wall opening, but it also allows relative radial movement between these elements after the engine has been assembled.

The system includes a support collar fixedly attached to the combustion chamber wall so as to extend around the generally circular opening in the upstream portion of the combustion chamber, as well as a locating flange fixedly attached to the pre-vaporizing bowl. A stud extending from the locating flange extends through a slot in the support collar such that only radial movement between the locating flange and the support collar ( and consequently between the pre-vaporizing bowl and the combustion chamber wall) is permitted.

A resilient snap clip is interposed between the support collar and the locating flange to exert a force on the locating flange, as well as the pre-vaporizing bowl, to overcome the effects of gravity and to maintain the pre-vaporizing bowl centered with respect to the combustion chamber wall opening. Once assembled, the force of the resilient snap clip is insufficient to prevent relative radial movement between the pre-vaporizing bowl and the combustion chamber wall.

DETAILED DESCRIPTION OF THE PREFERRED EMBODIMENT

Figure 1:
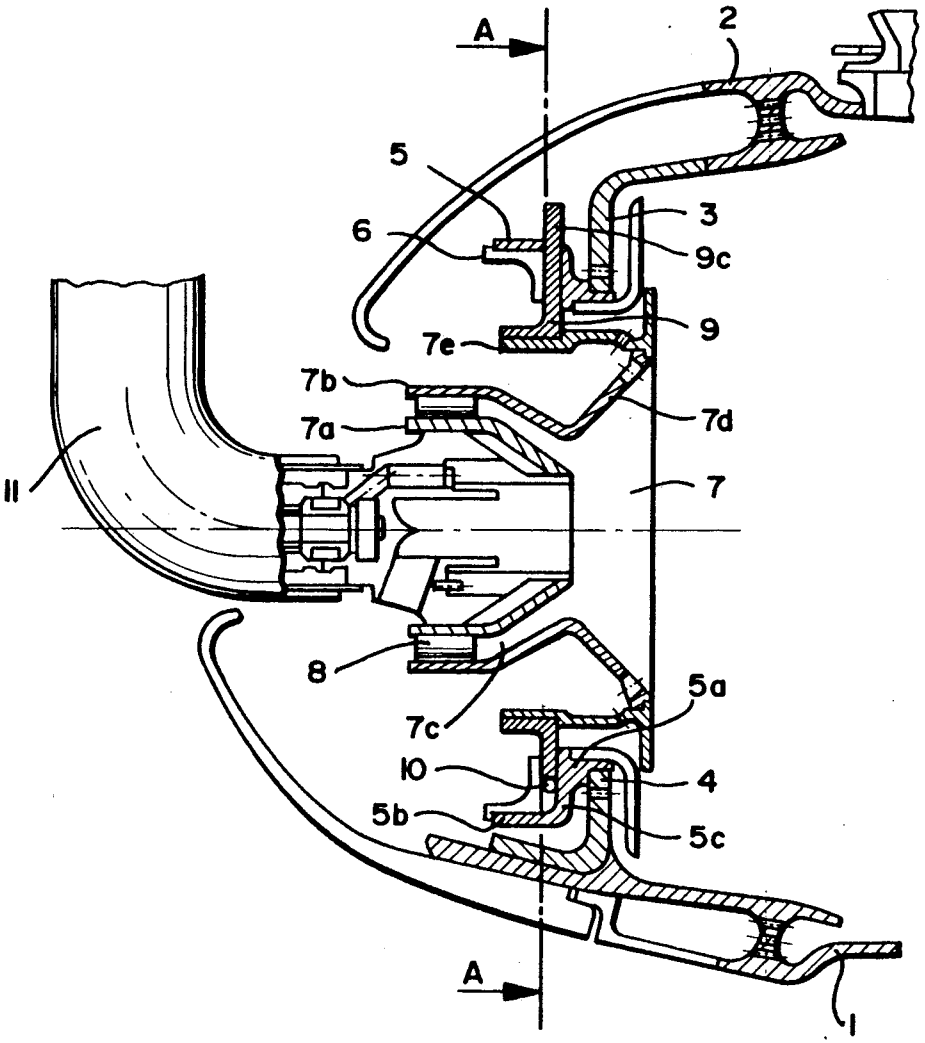
FIG. 1 is a partial, longitudinal cross-sectional view of an annular combustion chamber incorporating the mounting system according to the present invention.

FIG. 1 illustrates the mounting system according to the invention attached to an annular combustion chamber defined between inner annular wall 1 and outer annular wall 2. The upstream end wall 3 of the annular combustion chamber defines at least one opening 4 having a generally circular configuration.

The mounting system according to the present invention comprises a support collar 5 fixedly attached to the upstream end 3 of the combustion chamber so as to extend around the circular opening 4. The support collar 5 comprises an annular, downstream facing flange portion 5*a* that is welded to, or otherwise fixedly attached to, the inside of the opening 4. Support collar 5 also comprises an annular upstream facing portion 5*b*. The portions 5*a* and 5*b* are connected by a central generally radially extending portion 5*c*.

The pre-vaporizing bowl 7 comprises an internal member 7*a* and an external member 7*b* connected at their respective upstream portions by generally radial swirling fins 8. In known fashion, air passing into the pre-vaporizing bowl (from left to right as illustrated in FIG. 1) passes between the fins 8 which imparts a swirling motion to the incoming air. This optimizes the vaporization of the fuel emanating from fuel injection nozzle 11.

The internal member *7a* and the external member *7b* define a passageway *7c* through which the air passes after passing over the fins 8. The external member *7b* then defines a frusto-conical portion *7d* defining the downstream portion of the pre-vaporization bowl.

A cylindrical wall *7e* is welded, or otherwise fixedly attached, to the downstream edge of the frusto-conical *7d* and extends in a generally upstream direction therefrom. An axial portion *9a* of locating flange 9 is fixedly attached to the wall *7e* such that radial portion *9b* extends in a plane generally perpendicular to the longitudinal axis of the engine.

Figure 2:
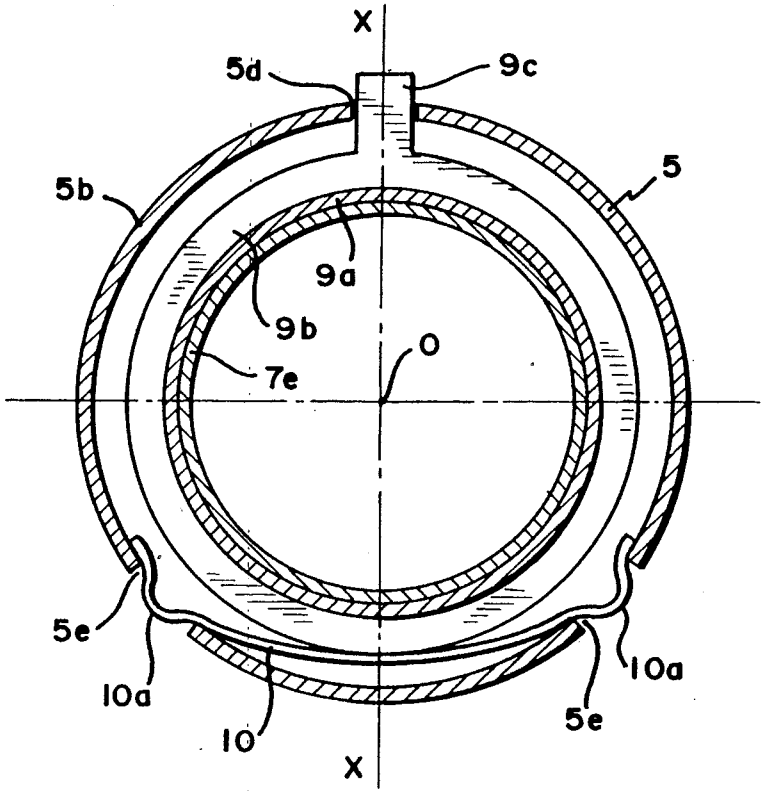
FIG. 2 is a lateral cross section taken along line A—A in FIG. 1.

As best seen in FIG. 2, a stud *9c* extends generally radially from the radial portion *9b* such that it passes through a slot *5d* defined by the support collar 5. A stop ring 6, which is fixedly attached to the upstream extending portion *5b* of the support collar 5, lies closely adjacent to the radial portion *9b* such that the locating flange 9 may move only in a radial direction with respect to the support collar 5. This allows the pre-vaporizing bowl 7 to move in a radial direction, generally along axis XX shown in FIG. 2, with respect to the circular opening 4 defined by the upstream end 3 of the combustion chamber.

A resilient snap clip 10 is operatively interposed between the support collar 5 and the locating flange 9 as illustrated in FIG. 2. The snap clip 10 has an arcuate shape with a radius of the arc being greater than either the radius of the locating flange 9 or the radius of the support collar 5. The snap clip 10 exerts a force on the locating flange 9 to keep both it and the pre-vaporizing bowl 7 centered and aligned with the center 0 of the opening 4.

A locating boss 10*a* is located at either end of the snap ring 10 to engage slots *5e* defined by the support collar 5. The slots *5e* are located relative to the axis XX such that the snap clip 10 exerts a force on the locating flange 9 generally opposite the stud *9c* and pointing toward the center 0.

In order to assemble the mounting system, the support collar 5 is first attached to the upstream end 3 of the combustion chamber. The pre-vaporizing bowl 7, to which the locating flange 9 has been fixedly attached, is placed in position in the support collar 5 and the snap clip 10 is positioned between them. The stop ring 6 is then welded to the inside of the support collar 5 such that the only relative movement between the support collar 5 and the locating flange 9 can take place in a radial direction.

The snap clip 10 is made of an alloy having high elasticity at the high temperatures encountered near the combustion chamber. The material may be a nickel-based superalloy NC 15 Fe T (French standard) commercially known as Inconel X 750 which comprises 50% Cr, 7% Fe, 2.4% Ti, and the remainder nickel. The alloy may be in work hardened form at 30–55%, chilled and tempered so that the snap clip can retain its resiliency within the temperature range encountered at the combustion chamber location.

Figure 4:
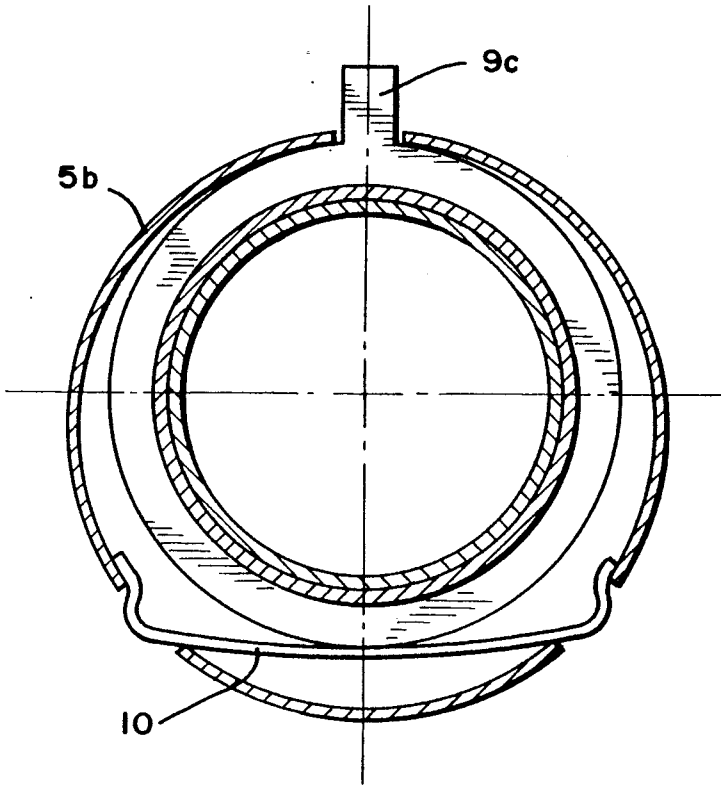
FIG. 4 is a lateral cross-sectional view, similar to FIG. 2, but illustrating the positions of the elements shown in FIG. 3.
Figure 3:
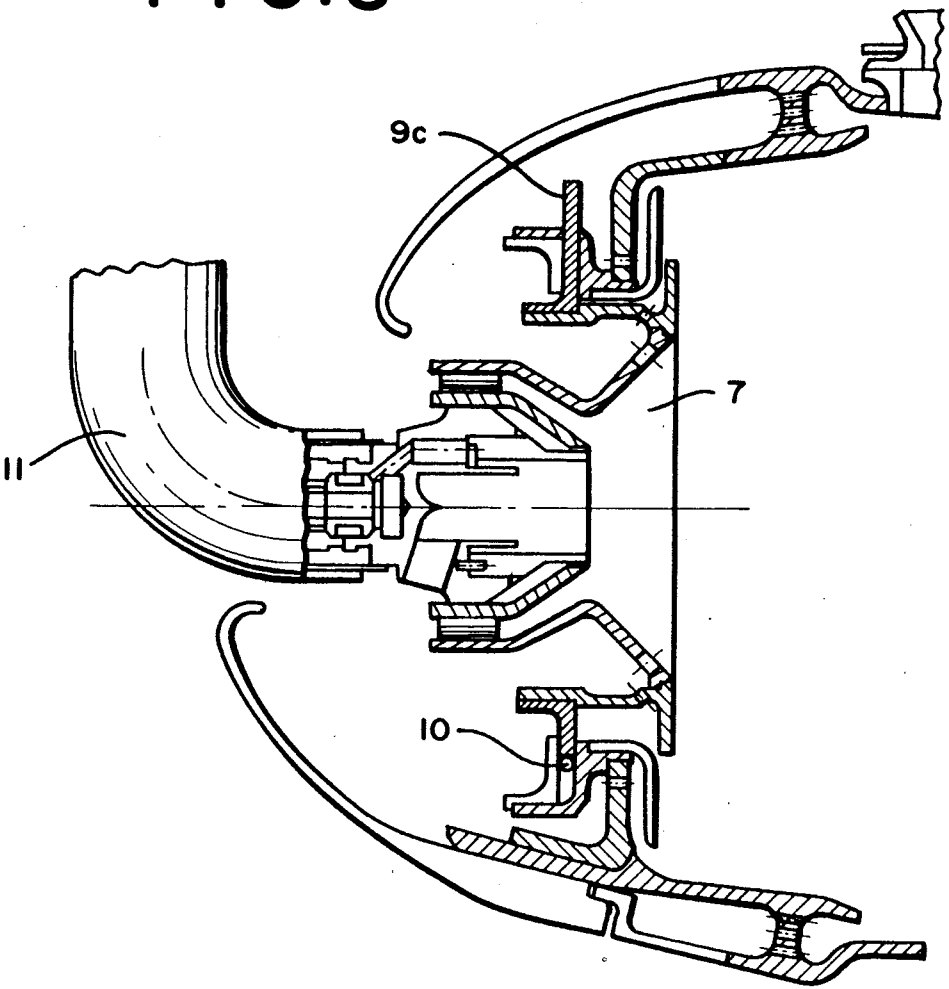
FIG. 3 is a partial, longitudinal cross-sectional view similar to FIG. 1 showing the pre-vaporizing bowl displaced eccentrically outwardly with respect to the combustion chamber wall opening.
Figure 6:
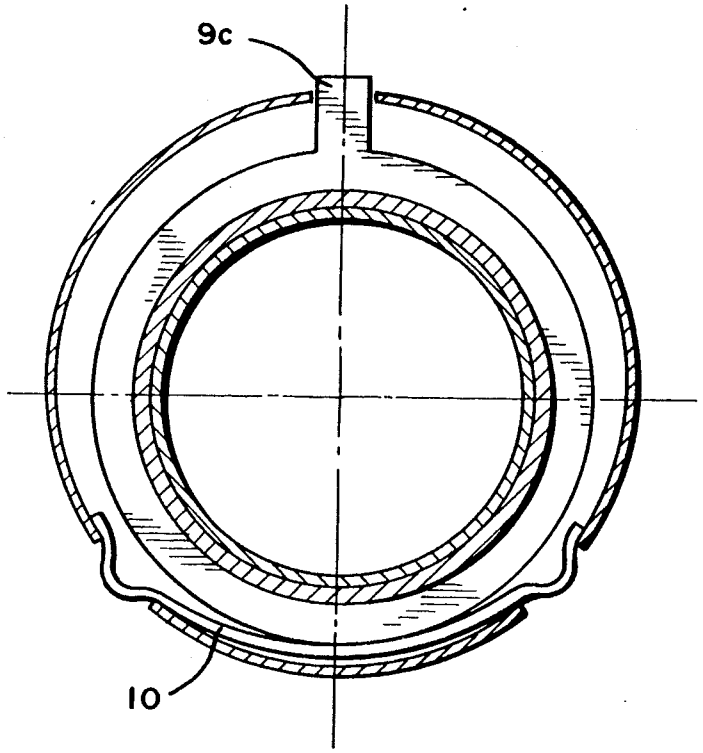
FIG. 6 is a lateral cross-sectional view, similar to FIG. 2, but illustrating the positions of the elements as shown in FIG. 5.
Figure 5:
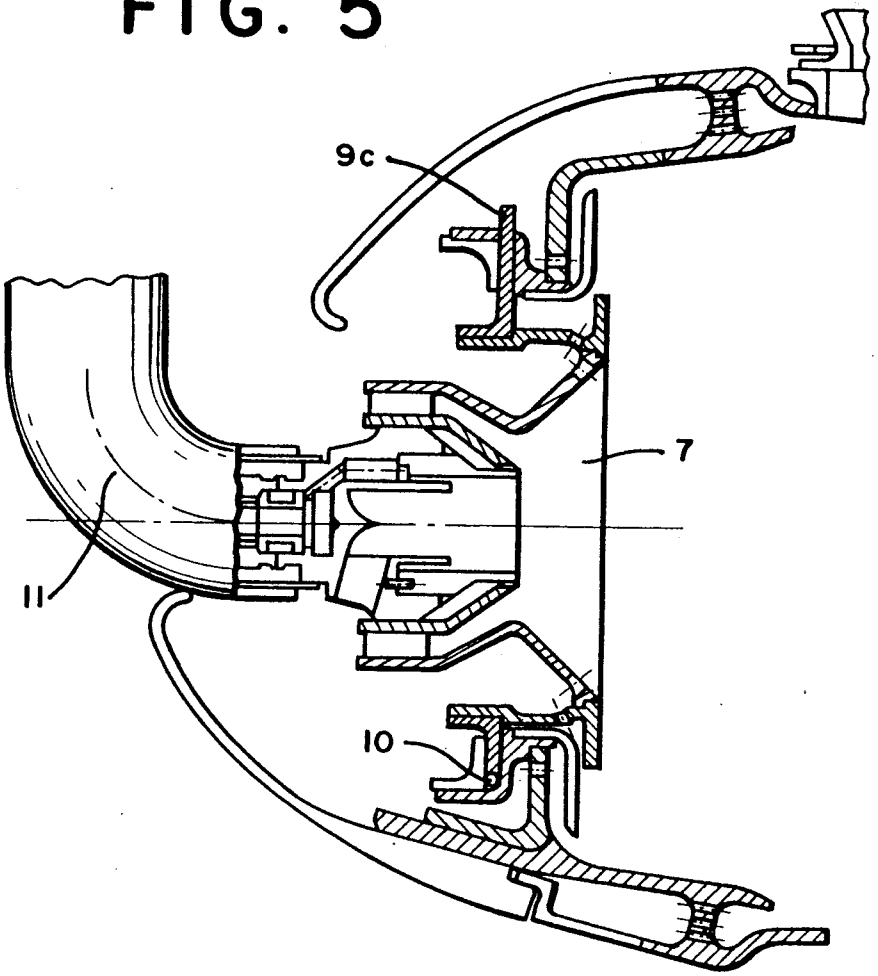
FIG. 5 is a partial, longitudinal cross-sectional view similar to FIG. 1, but showing the pre-vaporizing bowl displaced eccentrically inwardly with respect to the combustion chamber wall opening.

FIGS. 3 and 4 illustrate movement between the pre-vaporizing bowl 7 and the combustion chamber in which the pre-vaporizing bowl is radially displaced outwardly so as to be eccentric with respect to the center of the opening 4. FIGS. 5 and 6 show similar views, but with the pre-vaporizing bowl 7 displaced radially inwardly so as to be eccentric with respect to the center of the opening 4. It should be noted that the force exerted on the locating flange 9 by the snap clip 10 is not sufficient to impede the relative radial movement between these elements. The snap clip 10 supports the pre-vaporizing bowl 7 during the assembly process such that it is aligned with the center 0 of the opening 4.

Figure 7:
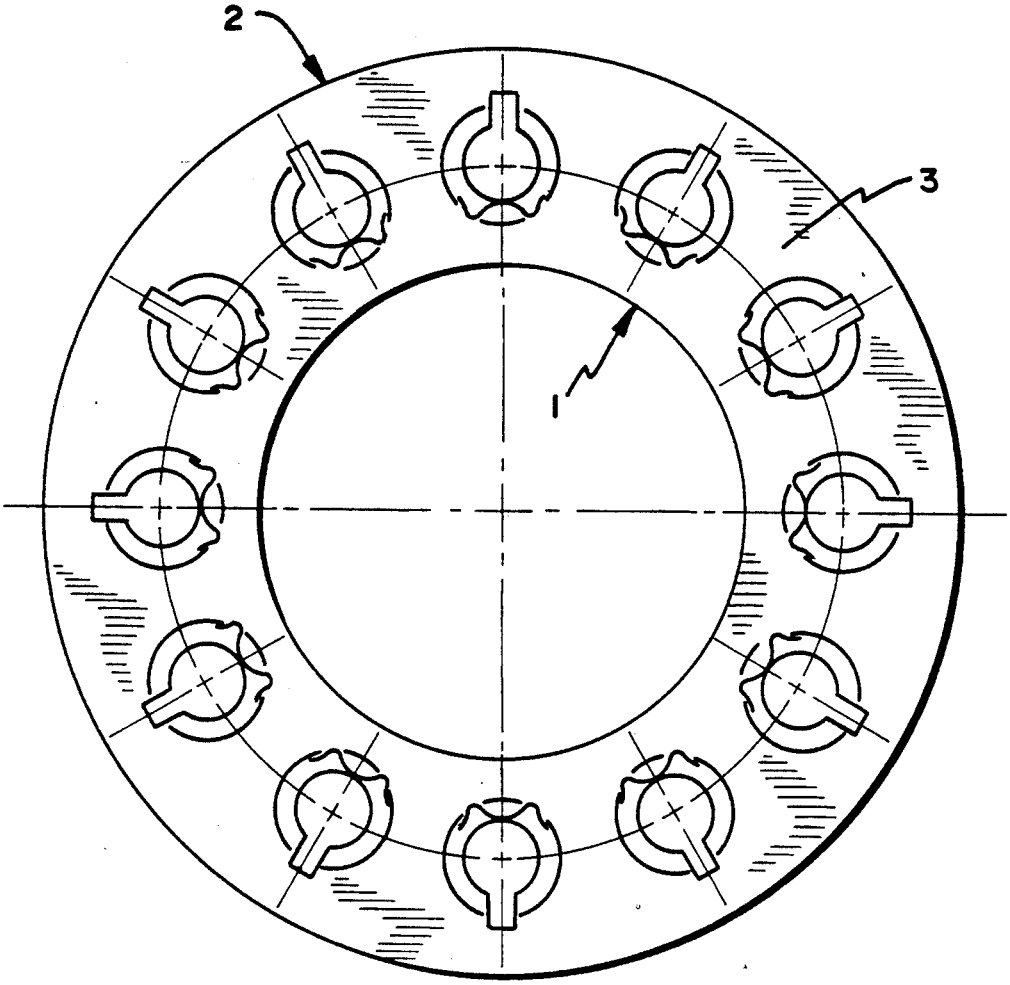
FIG. 7 is a schematic representation of a plurality of pre-vaporizing bowls arranged in an annular array around the longitudinal center line of the engine.

FIG. 7 schematically illustrates the end wall 3 of the combustion chamber defining a plurality of openings 4 located in a circular array around the longitudinal axis of the engine. A pre-vaporizing bowl is located in each of the openings 4 oriented such that the stud *9c* extends from the locating flange and through the support collar in a generally radial direction and in a plane extending generally perpendicular to the longitudinal axis of the engine. The snap clip 10 is located such that it applies its force to the locating flange 9 at a point generally opposite to the locating stud *9c*.

The foregoing description is provided for illustrative purposes only and should not be construed as in any way limiting this invention, the scope of which is defined solely by the appended claims.

We claim:

1. A system for mounting a pre-vaporizing bowl to a combustion chamber wall of a gas turbine engine having a longitudinal axis, comprising:

(a) a generally circular opening defined by an upstream end of the combustion chamber wall;

(b) locating flange means fixedly attached to the pre-vaporizing bowl;

(c) a support collar fixedly attached to said combustion chamber wall so as to extend around the opening;

(d) means interconnecting the locating flange means and the support collar so as to allow only generally radial movement therebetween thereby allowing generally radial movement between the pre-vaporizing bowl and the combustion chamber wall; and, (e) resilient means operatively interposed between the support collar and the locating flange means to exert a force on the locating flange means to locate the pre-vaporizing bowl in approximate alignment with the opening in the upstream end of the combustion chamber wall.

2. The mounting system according to claim 1 wherein the interconnecting means comprises:

(a) a generally radially opening slot defined by the support collar; and, (b) a generally radially extending stud extending from the locating flange means and located so as to pass through the slot.

3. The mounting system according to claim 2 wherein the resilient means exerts the force on the locating flange means at a point approximately opposite the radially extending stud.

4. The mounting system according to claim 3 wherein the resilient means comprises a snap clip having an arcuate shape, a radius of the arc being larger than a radius of the locating flange means and the support collar.

5. The mounting system according to claim 4 wherein the snap clip has a boss portion at each end and further comprising second slots defined by the support collar located such that a boss portion enters a second slot to attach the snap clip to the support collar.

6. The mounting system according to claim 1 wherein the resilient means is made of a high-temperature alloy metal.

7. The mounting system according to claim 1 wherein the resilient means is made of a nickel-based superalloy.

8. The mounting system according to claim 1 wherein the resilient means is made of a nickel-based superalloy having a composition of 15% Cr, 7% Fe, 2.4% Ti and the remainder Nickel.

9. The mounting system according to claim 2 wherein the upstream end of the combustion chamber wall defines a plurality of generally circular openings arranged in an annular array around the longitudinal axis of the engine.

10. The mounting system according to claim 9 wherein the studs extend from each locating flange means in a generally radial direction in a plane generally perpendicular to the longitudinal axis of the engine.

* * * * *